United States Patent [19]

Fincke et al.

[11] 4,050,040

[45] Sept. 20, 1977

[54] FAST-TUNED MULTIPLEXER-POWER COMBINER

[75] Inventors: George C. Fincke, West Allenhurst; George W. Taylor, Brielle, both of N.J.

[73] Assignee: The United States of America as represented by the Secretary of the Army, Washington, D.C.

[21] Appl. No.: 731,158

[22] Filed: Oct. 12, 1976

[51] Int. Cl.[2] ..... H01P 1/20; H01P 7/04; H01P 5/08; H01P 7/06

[52] U.S. Cl. ..... 333/73 C; 333/21 R; 333/82 B; 333/84 R; 333/97R

[58] Field of Search ..... 333/73 C, 73 R, 73 W, 333/73 S, 4–9, 1, 98 R, 97 R, 96, 21 R, 82 B, 84 R, 84 M; 330/56, 53; 331/101

[56] References Cited

U.S. PATENT DOCUMENTS

| | | | |
|---|---|---|---|
| 2,469,222 | 5/1949 | Atwood et al. | 333/73 C X |
| 2,798,206 | 7/1957 | Baroch | 333/73C |
| 3,969,681 | 7/1976 | Fincke | 330/56 |

*Primary Examiner*—Harold A. Dixon
*Assistant Examiner*—Marvin Nussbaum
*Attorney, Agent, or Firm*—Nathan Edelberg; Jeremiah G. Murray; Bernhard Franz

[57] ABSTRACT

A multiple-frequency, coaxial filter and coupler has a cylindrical outer casing surrounding two or more axial sections of the cylinder separated by radial vanes. Each of these sections forms a separate coaxial filter with a separate input at one end and an output, which is formed by a separate strip line positioned near the center of the cylinder. All of the strip lines are joined to the center conductor of a common coaxial output line. The center conductor of each of the separate coaxial filter sections may have a plurality of inductive spokes extending outwardly toward the cylindrical outer casing, or the adjacent radial vanes, and each of the inductive spokes may be terminated by a series-connected switching diode with its own separate source of bias to electrically connect or disconnect it to or from the corresponding casing or vane. This provides the combination of two or more variable frequencies in a common output.

17 Claims, 4 Drawing Figures

FAST-TUNED MULTIPLEXER-POWER COMBINER

The invention described herein may be manufactured, used or licensed by or for the Government for governmental purposes without the payment to us of any royalties thereon.

CROSS REFERENCE TO RELATED APPLICATION

A tuned amplifier having an amplifier tube combined with tuned strips, switched by diodes, or mounted within a tuned coaxial cavity that includes a single level of diode-shortable radial spokes, is seen in the copending application Ser. No. 497,788 of George Fincke for A "Fast Electronic Tuning of High Power Circuits for VHF-UHF Power Amplifiers At High Efficiency" filed Aug. 15, 1974, and now U.S. Pat. No. 3,969,381, issued July 13, 1976.

BACKGROUND OF THE INVENTION

One of the many problems in microwave transmission is the coupling of signals, particularly of different frequencies, into a common output. There are several types of hybrid circuits or couplers for this purpose, but, particularly in coaxial systems, these are usually confined to combiners that are limited to dual inputs, and will produce at least 3db loss at differing frequencies. Additional pairs of units may be combined, and recombined, to accommodate additional frequencies, but at an additional loss of 3db with each combination, and an ultimate limit to the efficiency and the number of frequencies that can, practically, be combined. Furthermore, these hybrid circuits cause intermodulation of the frequencies and tend to degrade the quality of the signals.

It is therefore an object of this invetion to provide a coaxial device for filtering and combining a plurality of different signals into a common coaxial output with negligible intermodulation and a loss of only 1db.

SUMMARY OF THE INVENTION

These and other objects are achieved by combining two or more tuned coaxial filter sections in a single cylindrical metallic casing. A series of radial vanes divide the cylindrical metallic casing into the desired number of coaxial tunable filter sections, which are actually wedge-shaped sections of the cylindrical casing—which form a part of the outer coaxial conductors of each of the tuned filters. The radial vanes complete the outer coaxial conductors for all of the tuned filters. The inner coaxial conductors, running through the central portion of the wedge-shaped sections, may be tubular, or of any convenient shape for optimum mechanical considerations and impedance matching. The outputs of the coaxial filter sections are taken by strips extending, axially, through each of the coaxial filters, equidistant from the axis of the outer cylindrical casing, and joining in a single, central conductor of a common coaxial, output cable.

DESCRIPTION OF THE PREFERRED EMBODIMENT

Figure 1:
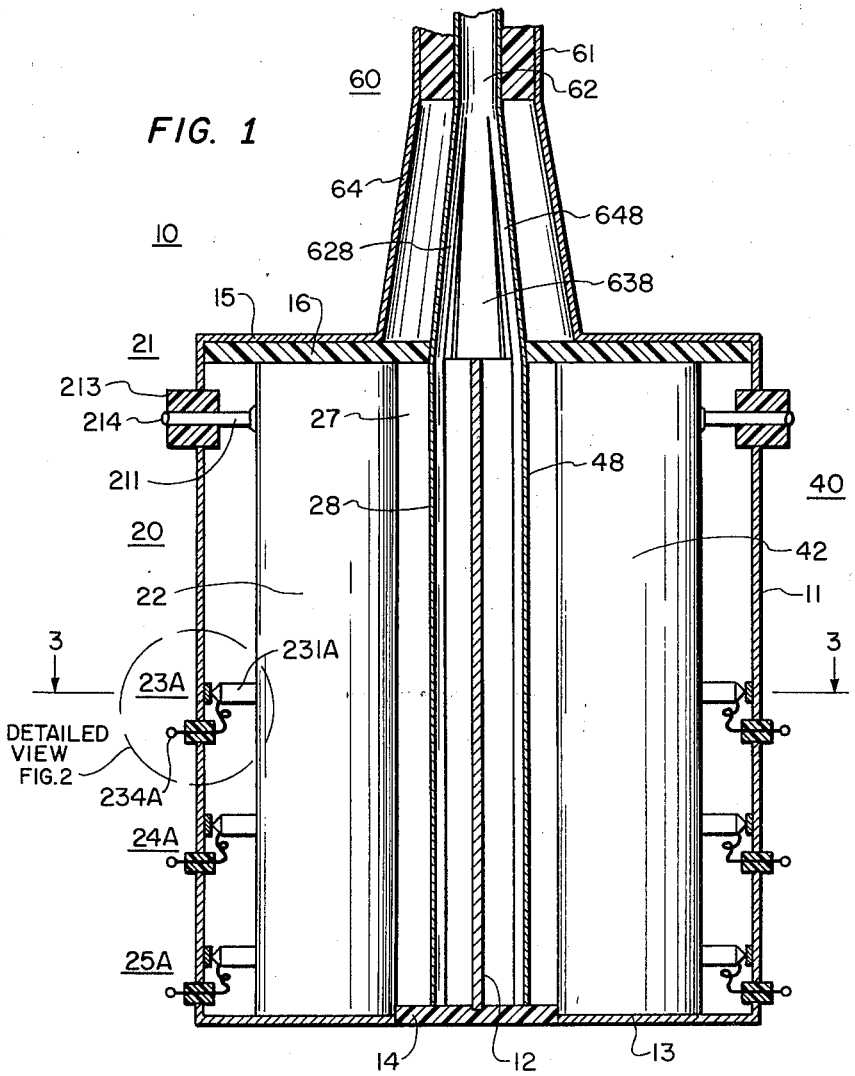
FIG. 1 shows a vertical cross section of a typical species of this invention.
Figure 3:
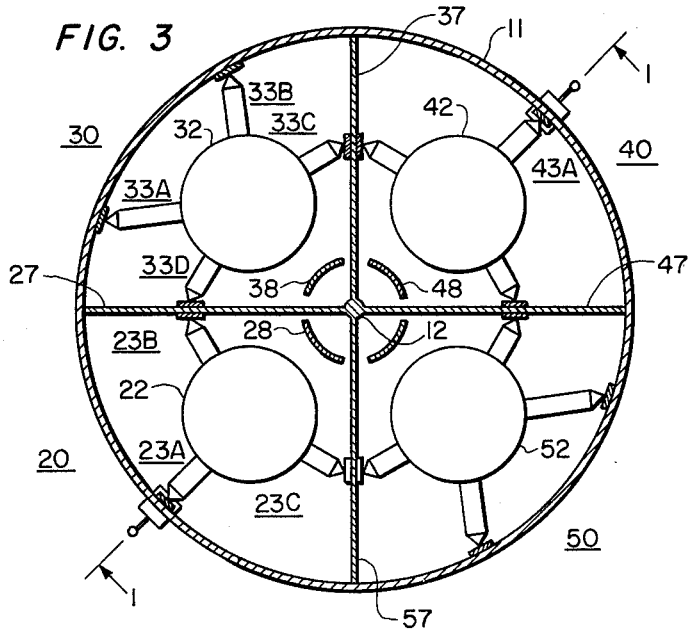
FIG. 3 shows a horizontal cross section of the species of FIG. 1.

Referring now more particularly to FIG. 1, a vertical cross section of a typical embodiment of this invention—along the lines 1—1 of FIG. 3—is shown with two of the coaxial filter sections 20 and 40 also in cross section. These coaxial filter sections have input connections similar to 21, which has a conductor 211 making contact with an inner coaxial conductor 22 and passing through an outer cylindrical casing or enclosure 11 through an insulator 213 to the input terminal 214.

The outer cylindrical casing 11 is mechanically and electrically connected to a base 13, which is also connected to a center rod 12. An insulated mounting 14 surrounds the center rod 12, and supports and separates the strip lines, such as 28 and 48 that carry the output signals.

Each coaxial filter section may also include levels of inductive spoke assemblies such as 23A, and 24A, etc. Each of the inductive spokes includes a spoke element such as 231A with a bias conductor 232A, more clearly seen in FIG. 2, extending through an insulator 233A to a control terminal 234A. A control or switching diode, for each inductive spoke, has an anode such as 235A mechanically and electrically connected to the outer cylindrical casing 11—or to one of the radial vanes—and a cathode 236A that connects to the inductive spoke element 231A of the inductive spoke assembly 23A.

The inductive spoke element of each of the inductive spokes is connected to a plate such as 237A that is electrically separated from the inner coaxial conductor 22, for direct current, by an insulating layer 238A. The spoke plates 237A, etc. must be separated from each other as well as from the inner coaxial conductor to permit separate biasing of each of the inductive spokes. This, again, is more clearly seen in FIG. 2. Each coaxial filter section may also include other levels of inductive spokes such as 24 and 25 which discrete inductive spokes and corresponding electrical control functions as defined for the level 23, with similar elements similarly numbered.

The strip lines such as 28 and 48 are shown to merge, through tapered strips such as 628 and 648, into a common inner conductor 62 of a coaxial output cable 60. This may be more clearly seen in the typical example of FIG. 4. The outer conductor 61 also tapers at 64 to be mechanically and electrically joined to a top plate 15 of the combined filters. An insulating layer 16 may separate and support the elements of the filters.

Figure 2:
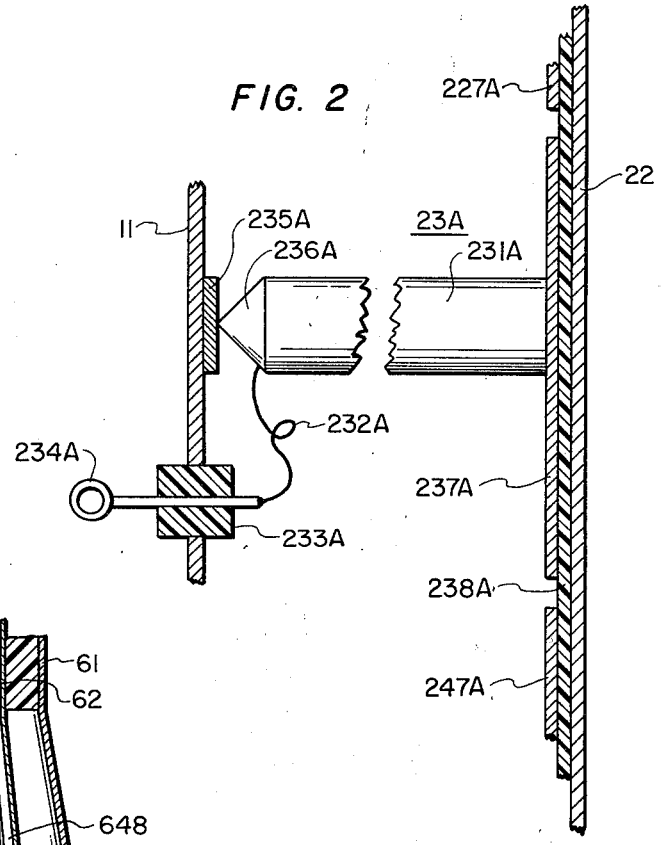
FIG. 2 shows an enlargement of a portion of FIG. 1.

FIG. 2 shows an enlargement of the inductive spoke assembly 23 to more clearly show the switching diode, the mounting and connections of the electrical elements, and, particularly, the capacitive coupling plate 237A for the inner end of the spoke along with its insulation 238A from the inner coaxial conductor 22. The same numbers are used in both figures for the same element.

FIG. 3 shows a cross section of the species of FIG. 1 along the lines 3—3 of FIG. 1, through the level 23 of inductive spokes. The same elements here and in all of the figures are similarly numbered. FIG. 3 shows a typical layout of inductive spokes such as 23A, 23B, and 23C around the inner coaxial conductor 22 of the coaxial filter section 20. Similar spokes are also seen in the opposing coaxial filter section 40, as well as in sections 30 and 50. However, the coaxial sections 30 and 50 are shown with four spokes, such as 33A–33D, rather than three spokes.

FIG. 3 shows more clearly the radial vanes such as 27, 37, etc. meeting in a center rod 12 and dividing the cylindrical casing or enclosure 11; and the output strip lines 28, 38, etc., as they would be positioned in corresponding coaxial filter sections.

Figure 4:
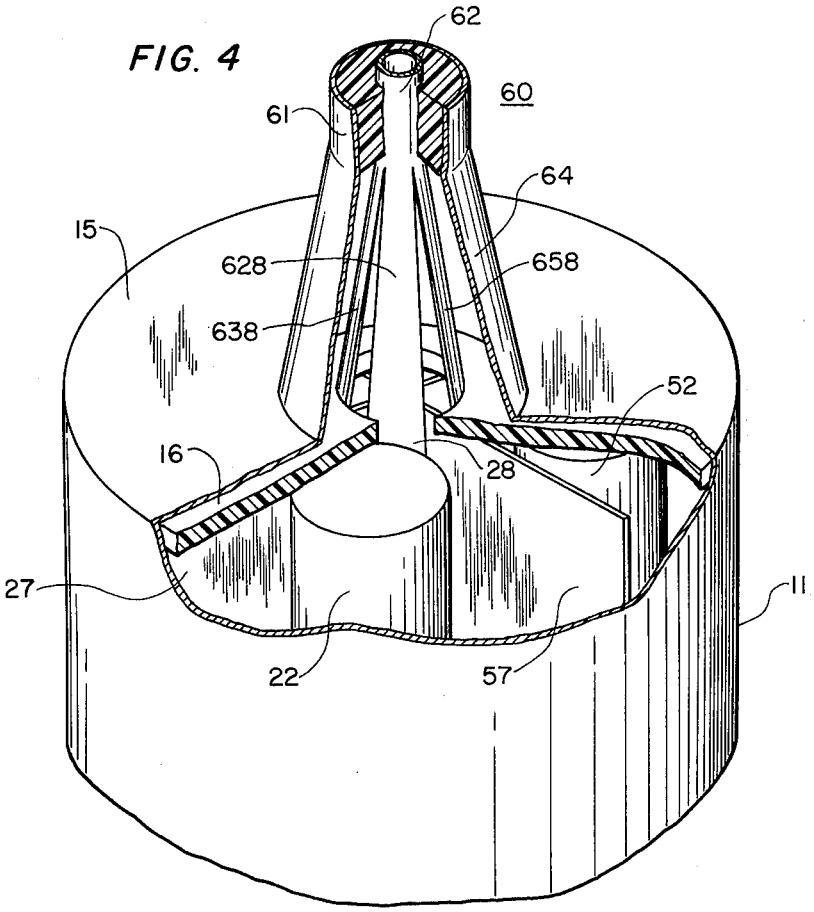
FIG. 4 shows an isometric view of a portion of the species of FIG. 1 to show the coupling of the strips providing the output of the separate coaxial filters.

FIG. 4 shows an isometric view of the upper portion of the species of the figures, cut open to show the physical relationship of the coaxial filter elements, as well as the mechanics of a typical junction of the strip lines such as 28, in each of the sections, through tapered strips 628, 638, and 658 into a common center or inner conductor 62 of the coaxial output 60.

FIG. 4 also shows the tapered conductor 64 connecting the outer conductor 61 of the coaxial output cable and the top cover 15 of the filter sections. Two of the inner coaxial conductors 22 and 52, of the corresponding filter section, are clearly seen, as are two of the radial vanes 27 and 57 that separate the various filter sections. The electrical elements such as the input connections and the inductive spoke assemblies, which are clearly seen in the other figures, are omitted for simplicity.

In operation, a signal applied to an input terminal such as 214 of the input connection 21 is applied to an inner coaxial conductor 22 of the corresponding coaxial filter section 20 through the input conductor 211, which is insulated at 213 from the outer casing 11. The resonant frequency of the coaxial filter section, in the TEM mode, is determined by the parameters of the coaxial section and in particular by its length.

Each of the coaxial filter sections may be varied in a well known manner, or may be supplied with a moveable metallic plate, not shown, that generally fills the area between, and makes electrical contact with, the inner conductor and the outer conductor of a given filter section. Moving such a plate up or down will vary the resonant frequency of the tuned coaxial filter in a well known manner.

However, in this invention, the effective length may also be established by the number and location of the inductive spokes that are brought into play by the biasing of the diodes between the inductive spokes and the adjacent outer conductor of the coaxial filter section. When a diode is back-biased, the inductive spoke is effectively disconnected, however, when a diode is forward-biased, the corresponding inductive spoke is effectively shorted between the outer conductive portion of the coaxial filter section and the inner coaxial conductor 22. This reduces the apparent length of the coaxial filter section, and changes the resonant frequency of the filter by a corresponding degree. The activation of more than one inductive spoke in any of the planes of spokes further changes the resonant frequency and it is possible to achieve a control of the filter frequency at small increments as well as over a considerable range.

Each of the coaxial filter sections may have a different resonant frequency setting by this means and all of the filtered signals are combined into the common coaxial output 60 along the strips 28, 38, etc. and the tapered junctions 628, 638, etc.

As seen in FIG. 2 the inner end of the inductive spoke element is capacitive-coupled to the inner coaxial conductor of the filter section through an insulated plate such as 237A. The outer end of the inductive spoke element is shorted to the outer coaxial conductor of the filter section through the forward-biased switching diode. This provides radio-frequency coupling between the inner and outer coaxial conductors while maintaining direct-current isolation for effective switching of the separate inductive spokes.

The plates, such as 237A are concentric with the inner coaxial conductor of the filter section, but are separated by the insulating layer 238A, as noted earlier. The plates should be as large as practical, without touching any adjacent plate, in the same plane, or one of the corresponding plates, such as 247A, in an adjacent plane, since all of the inductive spokes must be isolated electrically, for direct current, to permit individual control.

The insulation layer 238A between the spoke plates such as 237A and the inner coaxial conductor 22, should be as thin as possible within the predictable voltage requirements to provide the maximum coupling between the inner end of the inductive spoke element and the inner coaxial conductor.

A given plane may include as many spokes as mechanically practical or electrically advantageous. The more inductive spokes, the higher the degree of control, except that the effect of the additional inductive spokes may become negligible and not worth the extra problems and expense.

The inductive spokes would not necessarily be positioned symmetrically around the inner coaxial conductor, since this would provide only relatively uniform increments of frequency change. It would be better to provide combinations of inductive spokes that would provide both large and small variations of frequency change for a maximum degree of frequency control.

Any number of planes may be provided, again within practical limitations and the degree of control that is sought. The inductive spokes of one plane may effect the control of frequency in combination with the inductive spokes of another plane, except that once a plane is completely shorted, there should be little effect from an inductive spoke of a lower plane.

It is to be understood that we do not desire to be limited to the exact details of construction shown and described since obvious modifications will occur to a person skilled in the art.

What is claimed is:

1. A device for filtering and combining two or more radio-frequency signals in a single coaxial output comprising an outer metallic cylindrical enclosure having a bottom plate and a top plate; at least two radial vanes joined along the central axis of said cylindrical enclosure, and dividing said cylindrical enclosure into at least two sections that comprise the outer conductors of at least two coaxial filter sections; an inner coaxial conductor centrally positioned in each of said coaxial filter sections; the lower end of each of said inner coaxial conductors being connected to said bottom plate of said cylindrical enclosure; an input connection for each of said coaxial filter sections extending through said outer cylindrical enclosure and connected to the upper end of each said inner coaxial conductors; means for tuning each of said coaxial filter sections separately; a strip line extending axially through each of said coaxial filter sections, said strip lines being equidistant from said central axis of said cylindrical enclosure; a coaxial output means having an outer coaxial conductor and an inner coaxial conductor; means for coupling said outer coaxial conductor to said top plate of said cylindrical enclosure; means for coupling the upper end of said strip lines to said inner coaxial conductor of said coaxial output means; and means for applying each of said radio-frequency signals to a corresponding one of said input connections.

2. A device for filtering and combining radio-frequency signals as in claim 1 having four radial vanes dividing said cylindrical enclosure into four coaxial filter sections.

3. A device for filtering and combining radio-frequency signals as in claim 1 wherein each of said input connections comprises an input conductor having one end connected to said upper end of a corresponding one of said inner coaxial conductors and having an input terminal connected to the other end of said input conductor, and means for insulating said input conductor from said other metallic cylindrical enclosure.

4. A device for filtering and combining radio-frequency signals as in claim 1 having means for insulating the lower ends of said strip lines from said bottom plate and supporting said strip lines with respect to said bottom plate; and means for insulating said upper ends of said strip lines from, and supporting said strip lines with respect to, said top plate.

5. A device for filtering and combining radio-frequency signals as in claim 1 wherein said means for coupling said upper ends of said strip lines to said inner coaxial conductor of said coaxial output means comprises a tapered conductor extending from said upper end of each of said strip lines to said inner coaxial conductor of said coaxial output means.

6. A device for filtering and combining radio-frequency signals as in claim 1 wherein said means for coupling said outer coaxial conductor to said top plate of said cylindrical enclosure comprises a conical section tapered to accommodate said means for coupling said upper ends of said strip lines to said vertical coaxial conductor of said coaxial output means.

7. A device for filtering and combining radio-frequency signals as in claim 1 wherein said means for tuning each of said coaxial filter sections comprises means for changing the effective length of each of said coaxial filter sections.

8. A device for filtering and combining radio-frequency signals as in claim 1 wherein said means for tuning each of said coaxial filter sections comprises a plurality of inductive spokes and separate means for electrically connecting each of said inductive spokes between a corresponding one of said inner coaxial conductors and said outer coaxial conductors of said coaxial filter sections, at different positions within said coaxial filter sections.

9. A device for filtering and combining radio-frequency signals as in claim 8 wherein said inductive spokes are positioned in at least one plane equidistant from said bottom plate of said coaxial filter section.

10. A device for filtering and combining radio-frequency signals as in claim 8 wherein said inductive spokes are positioned in two or more separate planes at differing distances from said bottom plate.

11. A device for filtering and combining radio-frequency signals as in claim 8 wherein said means for electrically connecting each of said inductive spokes between a corresponding one of said inner coaxial conductors and said outer coaxial conductors of said coaxial filter sections comprises a plurality of switching diodes, each one connected, mechanically and electrically, in series with a corresponding one of said inductive spokes, and means for biasing said diodes to provide said means for electrically connecting said inductive spokes between said inner and outer conductors of said coaxial filter sections.

12. A device for filtering and combining radio-frequency signals as in claim 8 wherein a separate biasing means is provided for each of said diodes.

13. A device for filtering and combining radio-frequency signals as in claim 12 wherein said means for biasing each of said diodes to provide said means for electrically connecting said inductive spokes between said inner and outer conductors of said coaxial filter sections comprises an electrical connection through said outer metallic cylindrical enclosure associated with each of said inductive spokes.

14. A device for filtering and combining radio-frequency signals as in claim 13 wherein said electrical connection through said outer metallic cylindrical enclosure comprises a control terminal outside of said outer cylindrical enclosure; a biasing conductor connecting said control terminal to one of the electrodes of said switching diode, inside of said outer metallic cylindrical enclosure, the other electrode of said diode being connected to said outer metallic cylindrical enclosure; means for insulating said biasing conductor from said outer metallic cylindrical enclosure; and means for applying a control signal between said control terminal and said outer metallic cylindrical enclosure.

15. A device for filtering and combining radio-frequency signals as in claim 14 wherein said other electrode of said diode is directly mounted to said outer metallic cylindrical enclosure in line with said inductive spoke.

16. A device for filtering and combining radio-frequency signals as in claim 11 having means for direct current insulation and radio-frequency connection for each of said inductive spokes between a corresponding one of said inner coaxial conductors and said outer coaxial conductors of said coaxial filter sections.

17. A device for filtering and combining radio-frequency signals as in claim 16 wherein said means for providing direct current insulation and radio-frequency connection for each of said inductive spokes between a corresponding one of said inner coaxial conductors and said outer coaxial conductors of said coaxial filter sections comprises a layer of insulation surrounding said inner conductor, and a metallic plate, conforming with said inner conductor, attached to the inner end of each of said inductive spokes.

* * * * *